US010570579B2

(12) United States Patent
Chilton

(10) Patent No.: US 10,570,579 B2
(45) Date of Patent: Feb. 25, 2020

(54) ROLLER CART FOR EXCAVATION SUPPORT STRUCTURES AND METHODS FOR USING SAME

(71) Applicant: National Trench Safety, LLC, Houston, TX (US)

(72) Inventor: Ronald W. Chilton, Montgomery, TX (US)

(73) Assignee: NATIONAL TRENCH SAFETY, LLC, Houston, TX (US)

( * ) Notice: Subject to any disclaimer, the term of this patent is extended or adjusted under 35 U.S.C. 154(b) by 0 days.

(21) Appl. No.: 16/193,517

(22) Filed: Nov. 16, 2018

(65) Prior Publication Data

US 2019/0153694 A1 May 23, 2019

Related U.S. Application Data

(60) Provisional application No. 62/589,871, filed on Nov. 22, 2017.

(51) Int. Cl.
*E02D 17/08* (2006.01)

(52) U.S. Cl.
CPC ..... *E02D 17/08* (2013.01)

(58) Field of Classification Search
CPC combination set(s) only.
See application file for complete search history.

(56) References Cited

U.S. PATENT DOCUMENTS 3,309,799 A 3/1967 Kinkade
3,710,578 A 1/1973 Inoue
(Continued)

FOREIGN PATENT DOCUMENTS

EP 2261424 12/2010

OTHER PUBLICATIONS

International Search Report and Written Opinion for International Application No. PCT/US2018/061433, dated Feb. 1, 2019.
(Continued)

*Primary Examiner* — Kyle Armstrong
(74) *Attorney, Agent, or Firm* — Edmonds & Cmaidalka, P.C.

(57) ABSTRACT

A roller cart and methods for installing in an excavation support system. The roller cart can include a generally vertical back plate having a front surface, a back surface, a top end, and a bottom end. A generally horizontal base plate, having a top side and a bottom side, can be attached to the back plate at about a 90-degree angle, proximate the bottom end of the back plate. A first side plate and a second side plate that are generally L-shaped, having a generally vertical top portion, and a bottom portion that is generally perpendicular to the top portion can be attached to and generally perpendicular to the back surface of the back plate. The bottom portion of both side plates can be attached to and generally perpendicular to the bottom side of the base plate. The first side plate and the second side plate can be generally parallel to one another. A first plurality of guide plates can be attached to, and generally perpendicular to, the generally vertical top portion of the first side plate, and a second plurality of guide plates can be attached to, and generally perpendicular to, the generally vertical top portion of the second side plate. At least one roller can be connected to the back plate and extending from the back surface thereof. The roller acts as a contact point and ball bearing to compensate for any angular deviations from the vertical and straight lines of the excavation structure. This significantly eases installation and removal, and greatly reduces the time to install and remove the cart.

19 Claims, 14 Drawing Sheets

(56) References Cited

U.S. PATENT DOCUMENTS

| | | | | |
|---|---|---|---|---|
| 3,916,629 | A | 11/1975 | Thompson | |
| 3,950,952 | A | 4/1976 | Krings | |
| 4,019,328 | A * | 4/1977 | Koehl | E02D 17/04 405/282 |
| 4,376,599 | A | 3/1983 | Krings | |
| 4,453,863 | A | 6/1984 | Sutton et al. | |
| 4,657,442 | A | 4/1987 | Krings | |
| 4,874,271 | A | 10/1989 | Arnold | |
| 5,096,334 | A | 3/1992 | Plank | |
| 5,107,963 | A | 4/1992 | Rocca et al. | |
| 5,302,054 | A | 4/1994 | Winkler et al. | |
| 5,310,289 | A | 5/1994 | Hess | |
| 5,503,504 | A * | 4/1996 | Hess | E02D 17/08 405/282 |
| 5,931,607 | A | 8/1999 | Hess | |
| 6,821,057 | B1 | 11/2004 | Kadiu | |
| 6,848,865 | B2 | 2/2005 | Kadiu | |
| 7,056,068 | B2 | 6/2006 | Kadiu | |
| 7,258,511 | B1 | 8/2007 | Cerda | |
| 7,883,296 | B2 | 2/2011 | Meyer | |
| 8,403,599 | B2 * | 3/2013 | Hawkins | E02D 35/00 405/230 |
| 2002/0159844 | A1 | 10/2002 | Meyer | |
| 2004/0005197 | A1 | 1/2004 | Kadiu | |
| 2009/0110490 | A1 * | 4/2009 | Hess | E02D 17/08 405/282 |
| 2011/0058903 | A1 | 3/2011 | Kadiu | |

OTHER PUBLICATIONS

International Search Report and Written Opinion for International Application No. PCT/US2018/061443, dated Feb. 1, 2019.

* cited by examiner

ROLLER CART FOR EXCAVATION SUPPORT STRUCTURES AND METHODS FOR USING SAME

BACKGROUND

Field

Embodiments of the present invention generally relate to the installation and removal of excavation support structures, in particular to the installation and removal of slide rail trench shoring systems.

Description of the Related Art

In the excavation industry, cave-in and trench collapse are common safety hazards associated with open trench excavation methods. In addition to the inherent safety concerns, there are also productivity issues that must be addressed due to the man-hour requirements for the installation and removal of the excavation support structure.

Although slide rail trench shoring systems often eliminate many of the safety and productivity issues found when using trench shields, tight sheeting, beam and plate systems and wood shoring systems, there is still a need for continuous safety and productivity improvements in the industry. More particularly, there is a need for improvements in safety and job efficiency with the vertical mobility of hydraulic wale beams during installation and removal of slide rail trench shoring systems.

SUMMARY

A roller cart and methods for installing a roller cart in an excavation support system are provided. The roller cart can include a generally vertical back plate having a front surface, a back surface, a top end, and a bottom end. The roller cart can further include a generally horizontal base plate, having a top side and a bottom side, attached to the back plate at about a 90-degree angle, proximate the bottom end of the back plate. The roller cart can further include a first side plate and a second side plate that are generally L-shaped, having a generally vertical top portion, and a bottom portion that is generally perpendicular to the top portion. The top portion of both side plates is attached to and generally perpendicular to the back surface of the back plate. The bottom portion of both side plates is attached to and generally perpendicular to the bottom side of the base plate. The first side plate and the second side plate are generally parallel to one another. A first plurality of guide plates can be attached to, and generally perpendicular to, the generally vertical top portion of the first side plate, and a second plurality of guide plates can be attached to, and generally perpendicular to, the generally vertical top portion of the second side plate. At least one roller can be connected to the back plate and extending from the back surface thereof.

A roller cart system for an excavation support system is also provided. The system can include a first roller cart and a second roller cart, each of the roller carts comprising a generally vertical back plate having a front surface, a back surface, a top end, and a bottom end; a generally horizontal base plate, having a top side and a bottom side, attached to the back plate at about a 90-degree angle, proximate the bottom end of the back plate; a first side plate and a second side plate, wherein both side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another; a first plurality of guide plates attached to, and generally perpendicular to the generally vertical top portion of the first side plate, and a second plurality of guide plates attached to, and generally perpendicular to the generally vertical top portion of the second side plate; at least one roller, connected to the back plate, extending from the back surface thereof.

A linking beam can be configured to connect the first roller cart and the second roller cart when vertically aligned, wherein the linking beam has a top end and a bottom end, wherein the bottom end is positioned between the first side plate and the second side plate of the first roller cart, and wherein the top end is positioned between the first side plate and the second side plate of the second roller cart. The roller cart system can be easily moved in an upward and a downward direction relative to a vertical axis.

BRIEF DESCRIPTION OF THE DRAWINGS

The present disclosure is best understood from the following detailed description when read with the accompanying Figures. It is emphasized that, in accordance with the standard practice in industry, various features are not drawn to scale. In fact, the dimensions of the various features may be arbitrarily increased or reduced for clarity of discussion.

DETAILED DESCRIPTION

Figure 1:
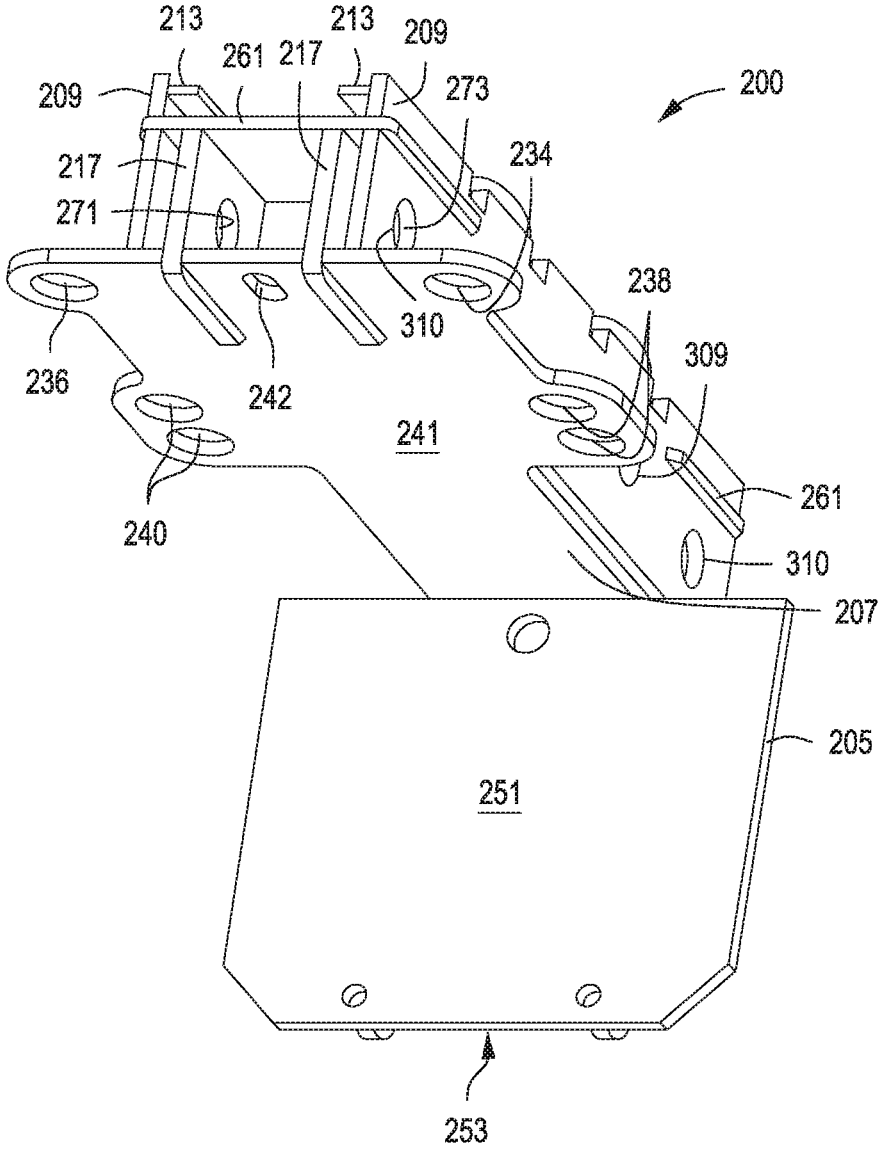
FIG. 1 depicts a side elevation view of an illustrative roller cart for an excavation support system, according to one or more embodiments provided herein.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

FIG. 1 depicts a side elevation view of an illustrative roller cart 200 for an excavation support system, according to one or more embodiments. The roller cart 200 can include a back plate 207, two side plates 209, at least one guide plate 213, and a space plate 261 (two are shown). The back plate 207 can have a front surface 241, a back surface 243, a top end 225, a bottom end 227, a first outer edge 221, and a second outer edge 223. Two or more generally parallel lock plates 217 can be disposed on the back surface 243 and extend away therefrom. The lock plates 217 can be generally perpendicular to the spacer plate 261, forming a void or opening therebetween. The lock plates 217 can include at least two openings or holes 271, 273 that are sized and shaped to receive a lock pin, chain, hook, or other mechanism for moving the cart 200. The roller cart 200 can further include a generally horizontal base plate 205 for supporting a wale beam 130 (FIGS. 12-13) as explained in more detail below.

Figure 1A:
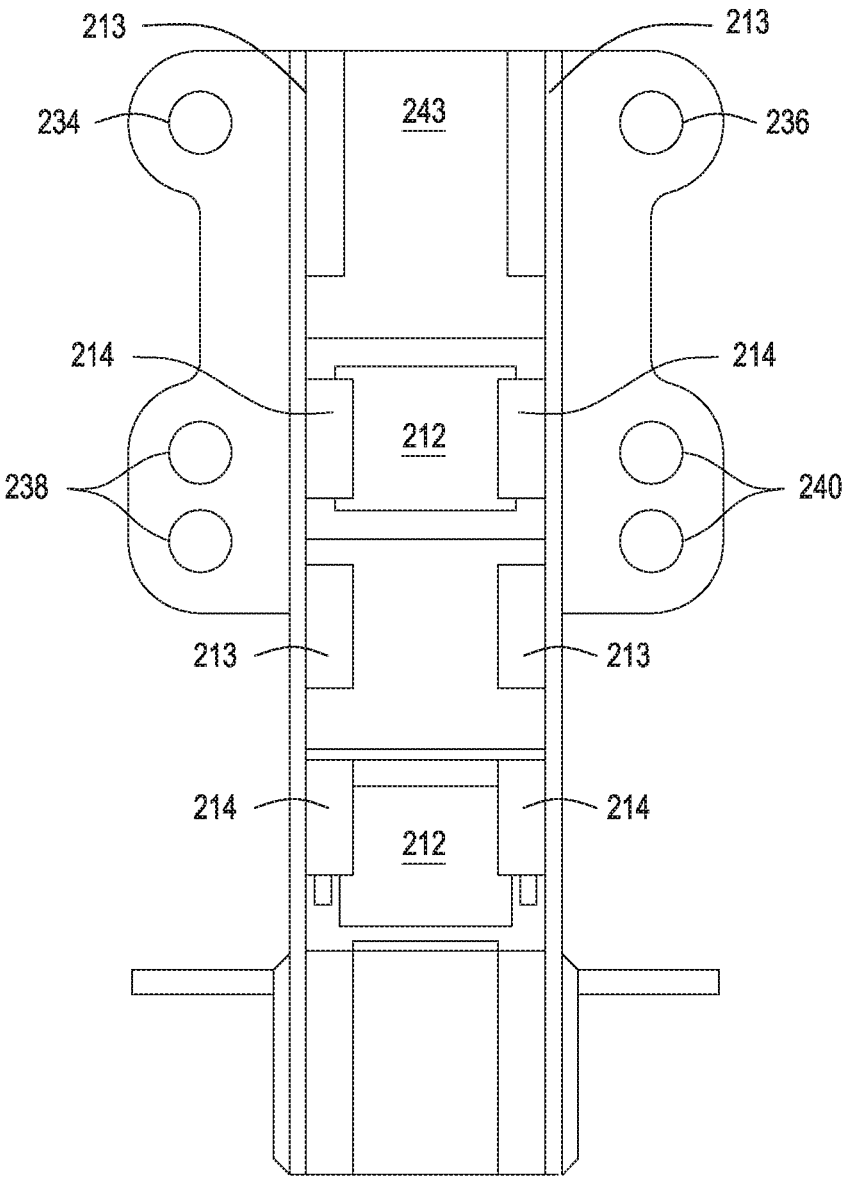
FIG. 1A depicts a rear view of the roller cart depicted in FIG. 1.

FIG. 1A depicts an illustrative view of the back surface of the roller cart 200, according to one or more embodiments. The roller cart 200 can further include at least one roller 212 mounted to the back surface 243. For example, the roller 212 can be mounted on the back plate 207, as depicted in FIG. 1A. As shown, the at least one roller 212 can be positioned between the two side plates 209, and secured in place by a housing or rigid caster 214. As explained in more detail below, the roller 212 decreases friction between the cart 200 and a linear slide-rail post 210 (see FIGS. 5-13) during installation and removal. The roller 212 also facilitates movement of the cart 200 up and down the vertical axis of the linear slide-rail post 210. The roller 212 acts as a contact point and ball bearing to compensate for any angular deviations from the vertical and straight lines of the linear slide-rail post 210. This significantly eases installation and removal, and greatly reduces the time to install and remove.

Figure 1B:
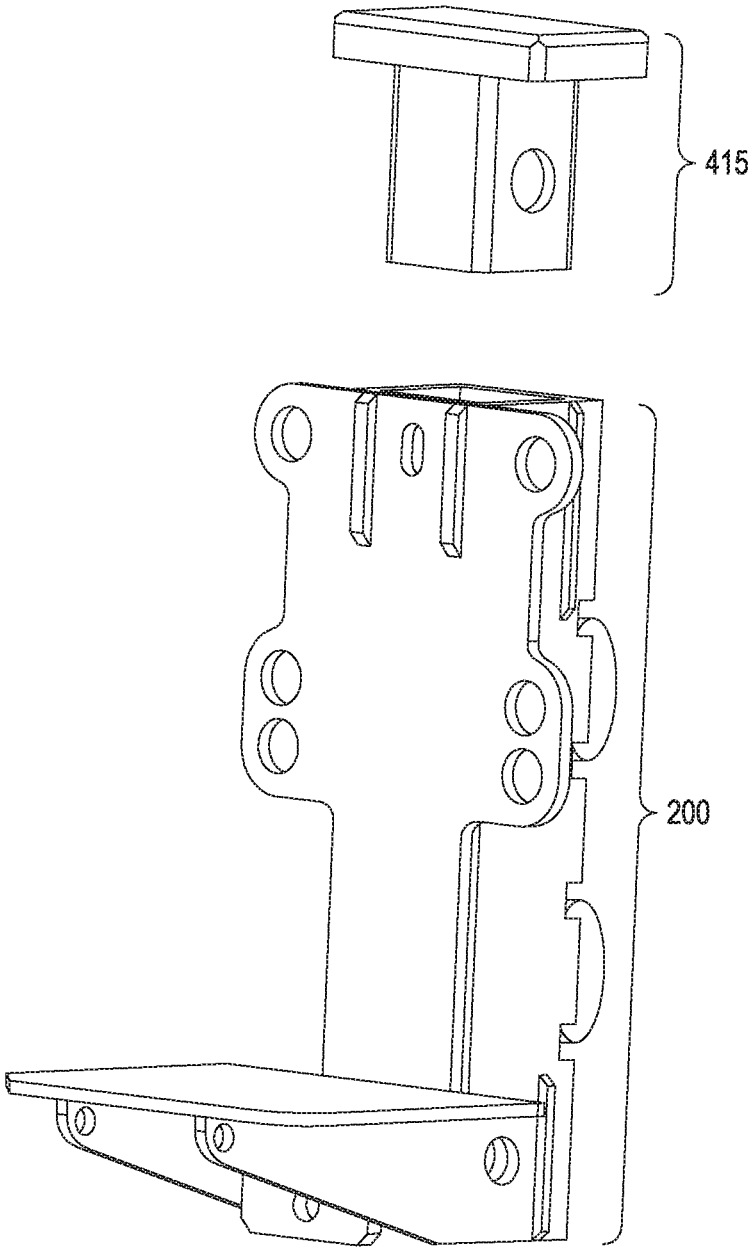
FIG. 1B depicts an exploded view of the roller cart of FIG. 1, according to one or more embodiments provided herein.

FIG. 1B depicts an exploded view of the roller cart of FIG. 1, according to one or more embodiments. The cart 200 can include a pounding cap 415 disposed at an upper end thereof. In use, the roller cart 200 can be moved in the downward direction along the vertical axis of the linear slide-rail post 210 using conventional machinery, such as an excavator, bulldozer, or the like. The roller cart 200 can be lowered or pushed in the downward direction to a desired position, such as the base of a trench, or any other position along the vertical axis of the linear slide-rail post 210. During installation, for example, the pounding cap 415 provides additional surface area so the boom of an excavator, for example, can hammer the cart 200 in a downward direction. The roller cart 200 can also have a lift ring (not shown) in place of the pounding cap 415. The lift ring can simply be an annular ring welded or otherwise attached to the top end of the cart 200, in place of the pounding cap 415. The lift ring can be connected to an excavator for the purpose of moving the cart 200 along the vertical axis of the linear slide-rail post 210. One or more holes, openings, or apertures 234, 236, 238, 240 can be used as lift points for moving the roller cart 200 in the upward and downward direction, or as connecting points for connecting the roller cart to the linear slide-rail post 210, or for connecting one or more wale beams 130 to the roller cart 200.

Figure 2:
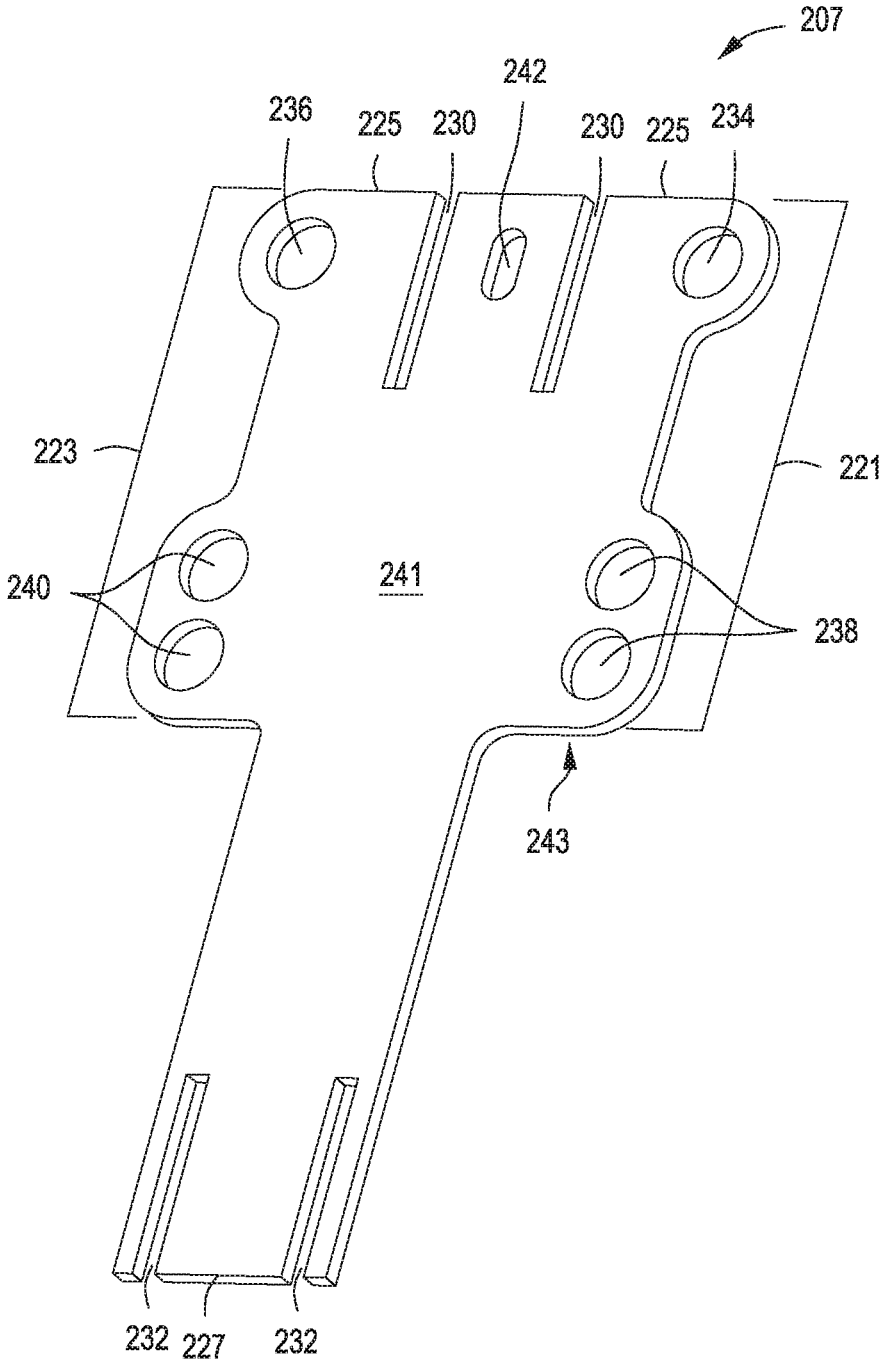
FIG. 2 depicts a perspective view of an illustrative back plate for the roller cart of FIG. 1, according to one or more embodiments provided herein.

FIG. 2 depicts a perspective view of the back plate 207, according to one or more embodiments. As mentioned above, the back plate 207 can have a front surface 241, a back surface 243, a top end 225, a bottom end 227, a first outer edge 221, and a second outer edge 223. The back plate 207 can further include at least one opening, hole or aperture 234 formed therethrough and positioned proximate the top end 225 of the first outer edge 221, and at least one aperture 236 formed therethrough and positioned proximate the top end 225 of the second outer edge 223. The back plate 207 can also include one or more additional apertures 242 positioned proximate the top end 225. The back plate 207 can also include one or more apertures 238 positioned below the at least one aperture 234 positioned proximate the top end 225 of the first outer edge 221. Likewise, the back plate 207 can include one or more apertures 240 positioned below the at least one aperture 236 positioned proximate the top end 225 of the second outer edge 223. Additionally, the back plate 207 can include two or more generally vertical top notches 230, where the vertical top notches 230 can be configured to engage with lock plates 217. Moreover, the back plate 207 can include two or more generally vertical bottom notches 232 that also can be configured to engage with corresponding lock plates 217.

At least a portion of both the first outer edge 221 and the second outer edge 223, proximate the top end 225 of the back plate 207 can be curved. The apertures 234, 236 located proximate the top end 225 can be formed through the convex, curved portion of the first outer edge 221 and the second outer edge 223. The apertures 234, 236, 238, 240, and 242 can be configured to engage with connecting or securing devices, where the connecting or securing devices can include pins, dowels, screws, clamps, or any of a variety of fasteners. The apertures 238, 240 can provide a point of connection between the back plate 207 and the wale beam 130. The apertures 234, 236 can be used as points of connection or lifting points for cables, where the cables are used to move the cart 200 up and down the linear rail. The apertures 234, 236 can be lift points, for the purpose of connecting the back plate 207 of the roller cart 200 to cables. The connection of the roller cart 200 to the lifting cables can facilitate movement of the roller cart 200 in the upward and downward direction along the vertical axis of the linear slide-rail 210.

The back plate 207 can provide additional stability and support for the wale beam 130 (see FIGS. 12-13) after the wale beam 130 has been positioned and connected to the roller cart 200. Moreover, the back plate 207 can prevent lateral movement of the linear cart 200 after the wale beam 130 has been positioned and pressurized on the linear cart 200. For example, the apertures 238, 240 can provide points of connection between the roller cart 200 and the wale beam 130. Complimentary apertures can be disposed through adjacent portions of the wale beam 130, thereby allowing insertion of a connector, such as a pin, dowel, screw, clamp, or any variety of fasteners, through both the wale beam aperture and the adjacent roller cart aperture 238, 240.

Figure 3:
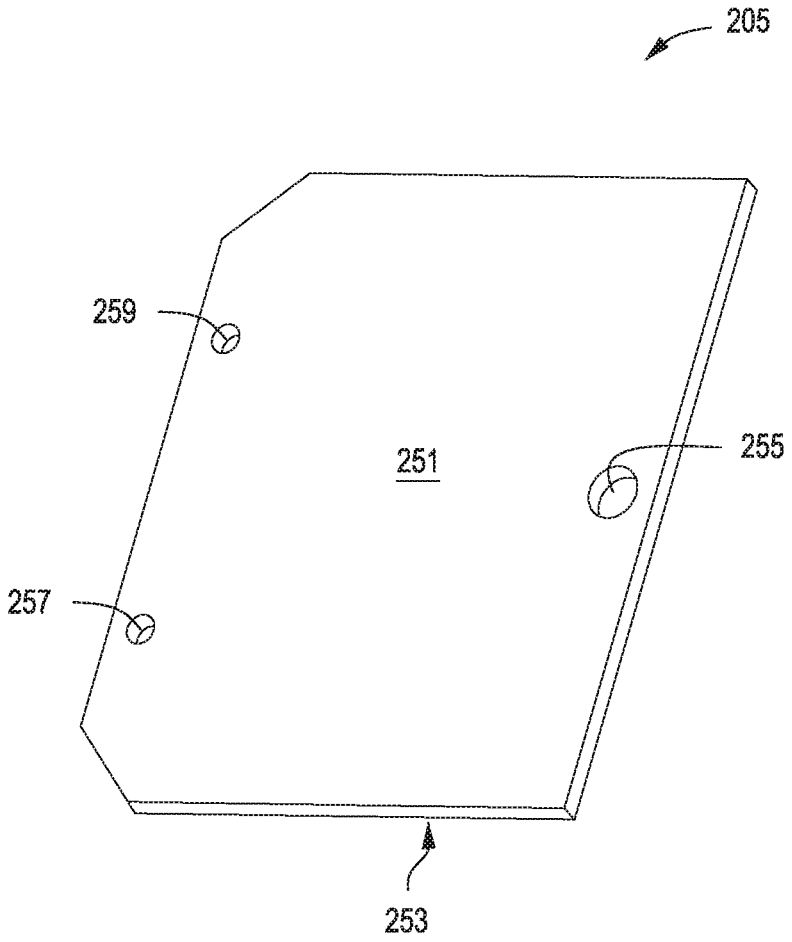
FIG. 3 depicts a perspective view of an illustrative generally horizontal base plate for the roller cart of FIG. 1, according to one or more embodiments provided herein.

Considering the base plate 205 in more detail, FIG. 3 depicts a perspective view of an illustrative generally horizontal base plate 205 for the roller cart of FIG. 1, according to one or more embodiments. The base plate 205 can include a top side 251 and a back side 253. Moreover, the base plate 205 can be attached to the back plate 207 at about a 90-degree angle, proximate the bottom end 227 of the back plate 207. In some embodiments, the base plate 205 also can include one or more apertures 255 positioned proximate the location of attachment to the back plate 207. The base plate 205 can further have at least two additional apertures 257, 259 positioned opposite the location of attachment to the back plate 207. The apertures 257, 259 can be configured to engage with connecting or securing devices such as pins, dowels, screws, clamps, or any of a variety of fasteners. Moreover, the aperture 255 can be configured to engage with similar connecting or securing devices, or any of a variety of fasteners for the purpose of connecting the base plate 205 to at least one wale beam 130. The base plate 205 can essentially function as a seat or table for the placement, joinder, and secure connection of at least one wale beam 130, or up to two wale beams 130.

Figure 4:
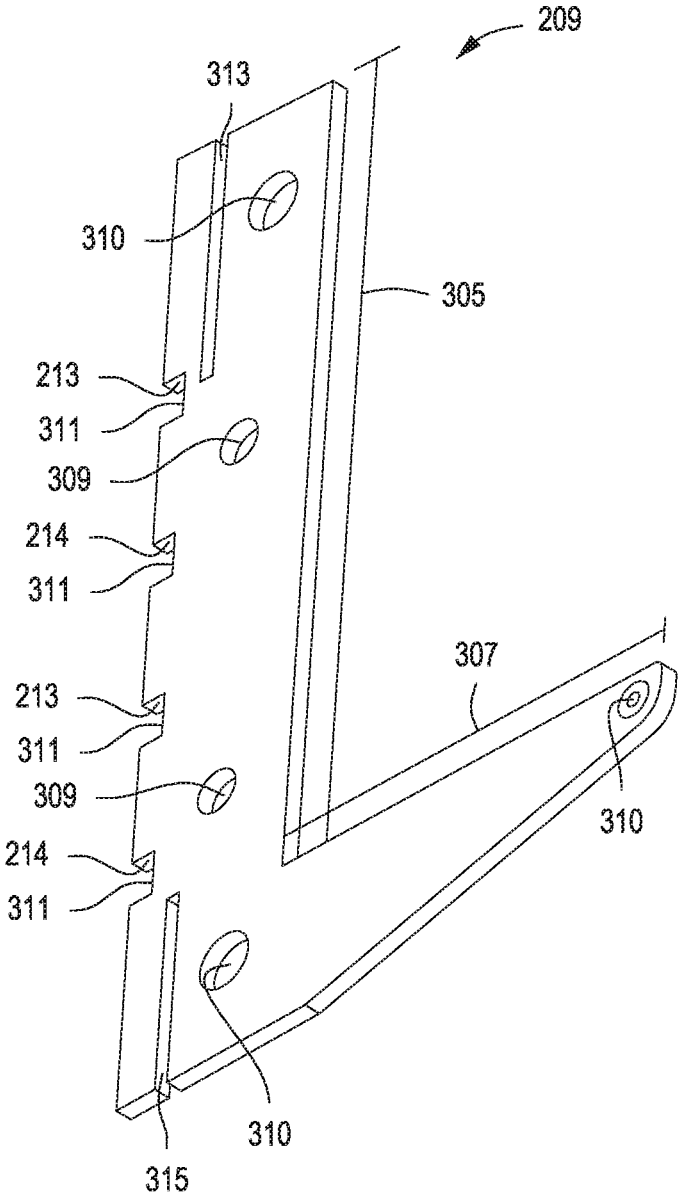
FIG. 4 depicts a perspective view of an illustrative side plate for the roller cart of FIG. 1, according to one or more embodiments provided herein.

FIG. 4 depicts a perspective view of an illustrative side plate 209 for the roller cart of FIG. 1, according to one or more embodiments. Referring to FIGS. 1 and 4, the roller cart 200 can have at least two side plates 209 (a first side plate 209A and a second side plate 209B). In some embodiments, the side plates 209 can be L-shaped, having a generally vertical top portion 305 and a bottom portion 307 that is generally perpendicular to the top portion 305. In other embodiments, the at least two side plates 209 can be generally vertical and I-shaped. The side plates 209 can include at least 2 apertures 309, 310 (five are shown in FIG. 4). The side plates 209 can have at least one generally vertical top notch 313, and at least one generally vertical bottom notch 315 that can be configured to engage with the spacer plate 261.

At least one guide plate 213 can be attached to, and generally perpendicular to, the generally vertical top portion 305 of the first side plate 209. Likewise, at least one guide plate 213 can be attached to, and generally perpendicular to, the generally vertical top portion 305 of the second side plate 209. Moreover, the side plates 209 can also include two or more notches 311 distributed along an outer vertical edge. The notches 311 can essentially function as spacers between each one of the pluralities of guide plates 213. For example, the length of the notches 311 can vary, depending upon the preferred separation distance between each of the pluralities of guide plates 213.

The first side plate 209 and the second side plate 209 can be in parallel relation to one another. At least one spacer plate 261 can be disposed through the generally vertical corresponding top notches 313 of the side plates 209. The spacer plate 261 can securely maintain the preferred spacing or distance between the two side plates 209. The separation distance between the side plates 209 can be from about 5 inches to about 12 inches, from about 6 inches to about 11 inches, from about 7 inches to about 10 inches, or from about 8 inches to about 9 inches. The separation distance can be up to 12 inches, up to 11 inches, up to 10 inches, or up to 9 inches.

Figure 5:
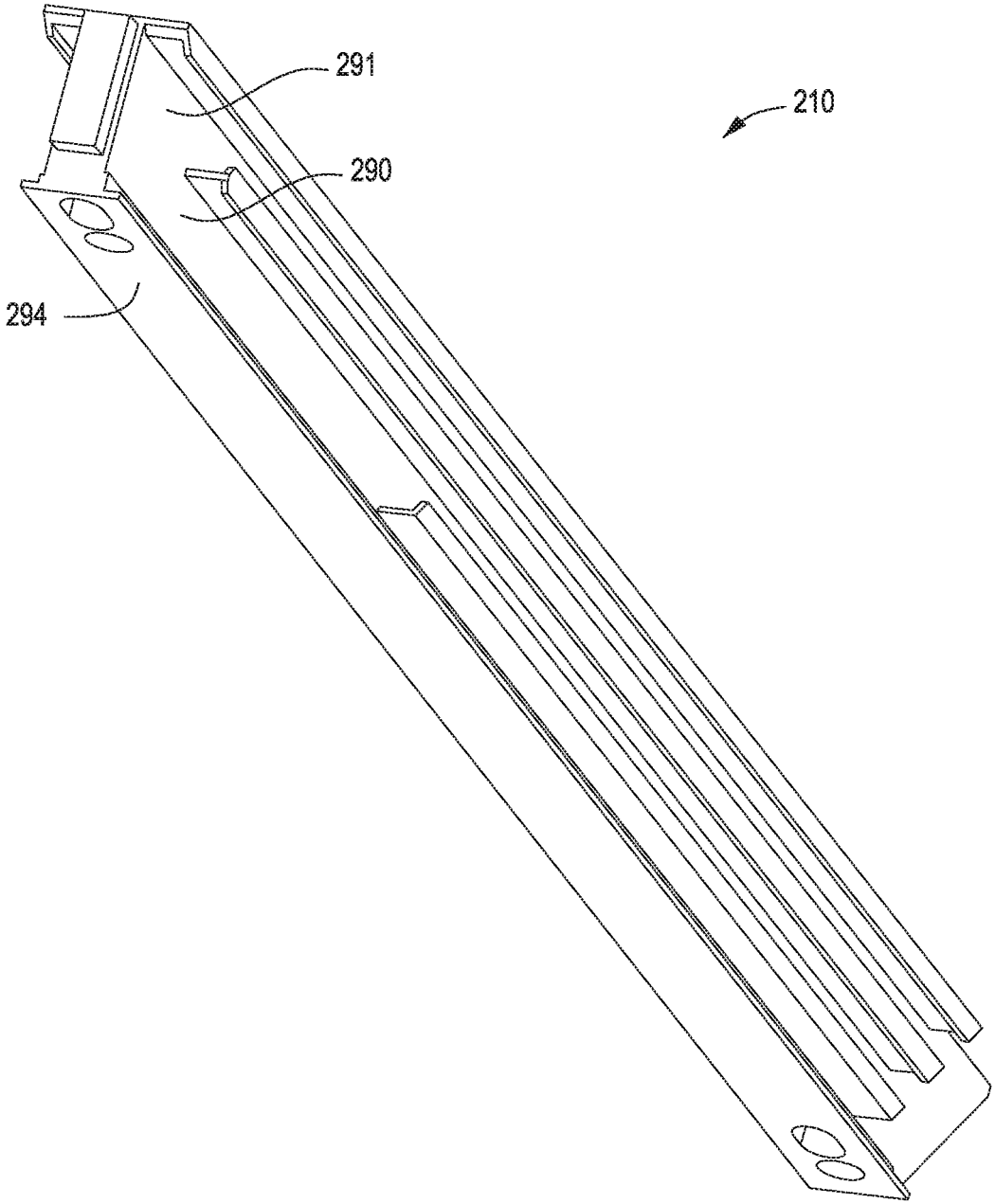
FIG. 5 depicts a side elevation view of an illustrative linear slide-rail post, according to one or more embodiments provided herein.

FIG. 5 depicts a side elevation view of an illustrative linear slide-rail post 210, according to one or more embodiments. As shown in FIG. 5, the at least one roller 212 can be configured to extend from the back surface 243 of the back plate 207 of the roller cart 200 to contact the linear slide-rail post 210 at the extended faceplate 294; thereby, facilitating ease of movement in the upward and downward direction along the vertical axis of the linear slide-rail post 210. Moreover, the pluralities of guide plates 213 can be configured to connect to, or clasp, the linear slide-rail post 210 at or near the vertical edges of the extended faceplate 294. The extended faceplate 294 can be disposed along the longitudinal axis of the linear slide-rail post 210. In some embodiments, a front recessed groove or track 291 can function as an outer track 291, wherein a first or lower elongated panel 105 can be slideably positioned therein. In some embodiments, an additional recessed groove or track 290 can function as an inner track 290, wherein a second elongated panel or elongated extension panel can be slideably positioned therein. At least a third or additional recessed grooves or tracks 290 can be used, wherein at least a third or additional elongated panels or elongated extension panels can be slideably positioned therein (not shown).

Figure 6:
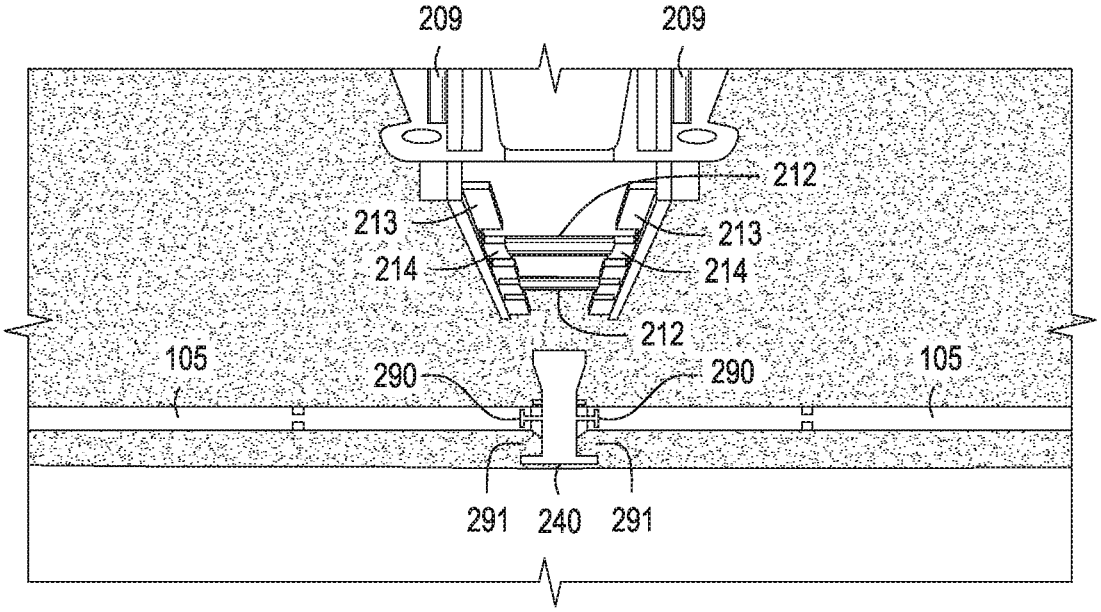
FIG. 6 depicts a rear elevation view showing the installation of the illustrative roller cart of FIG. 1, prior to being connected to the illustrative linear slide-rail post of FIG. 5, according to one or more embodiments provided herein.

FIG. 6 depicts a rear elevation view showing the installation of the illustrative roller cart of FIG. 1, prior to being connected to the illustrative linear slide-rail post of FIG. 5, according to one or more embodiments provided herein. As the roller cart 200 is lowered onto the linear slide-rail post 210, the bottom most set of guide plates 213 can be clamped or clasped onto the vertical edges of the extended faceplate 294. The at least one roller 212 can facilitate ease of movement of the roller cart 200 during both installation and removal, or for the purpose of movement in the upward and downward direction, along the vertical axis of the linear slide-rail post 210.

Figure 7:
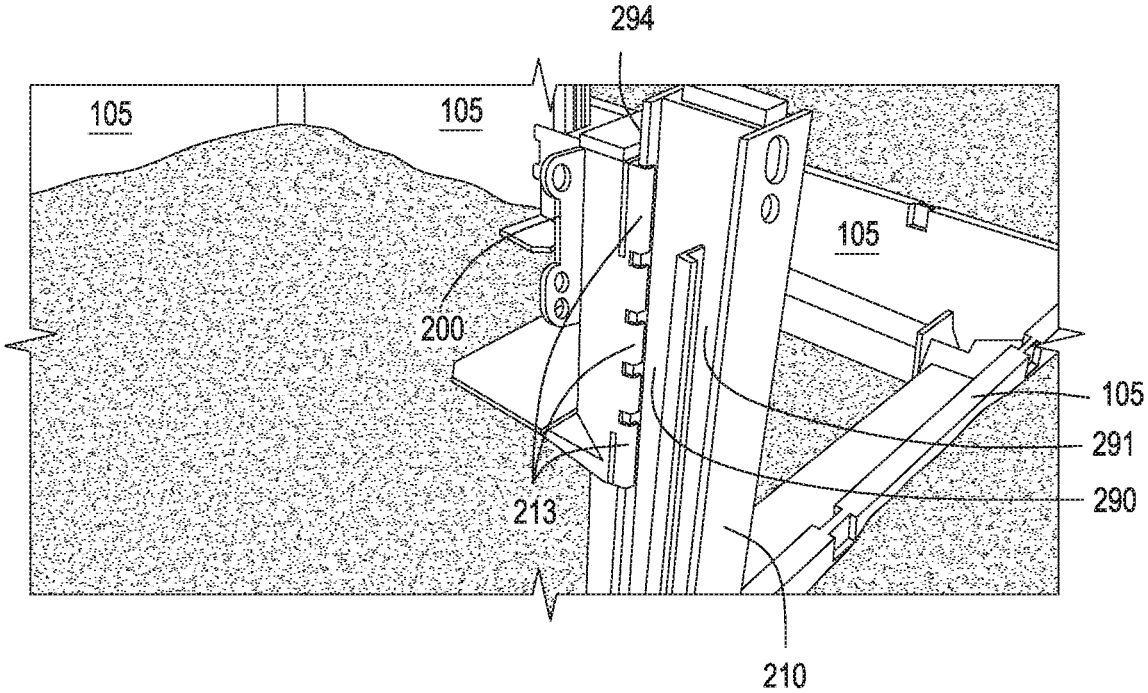
FIG. 7 depicts a side elevation view of the roller cart of FIG. 1, showing a side plate, guide plates, and the insertion of the guide plates into a recess or track of the slide-rail post for an illustrative excavation support system, according to one or more embodiments provided herein.

FIG. 7 depicts a side elevation view of the roller cart of FIG. 1 showing a side plate 209, guide plates 213, and the insertion of the guide plates 213 into a recess or track 291 of the slide-rail post 210 for an excavation support system, according to one or more embodiments. FIG. 7 further depicts the connection of the roller cart 200 to the extended faceplate 294 of the linear slide-rail post 210. As shown, the plurality of guide plates 213 can be configured to essentially clamp around or capture the edge of the extended faceplate 294, thereby facilitating movement of the roller cart 200 in an upward and downward direction relative to the vertical axis of the linear slide-rail post 210, and securing the attachment of the roller cart 200 thereto.

Figure 8:
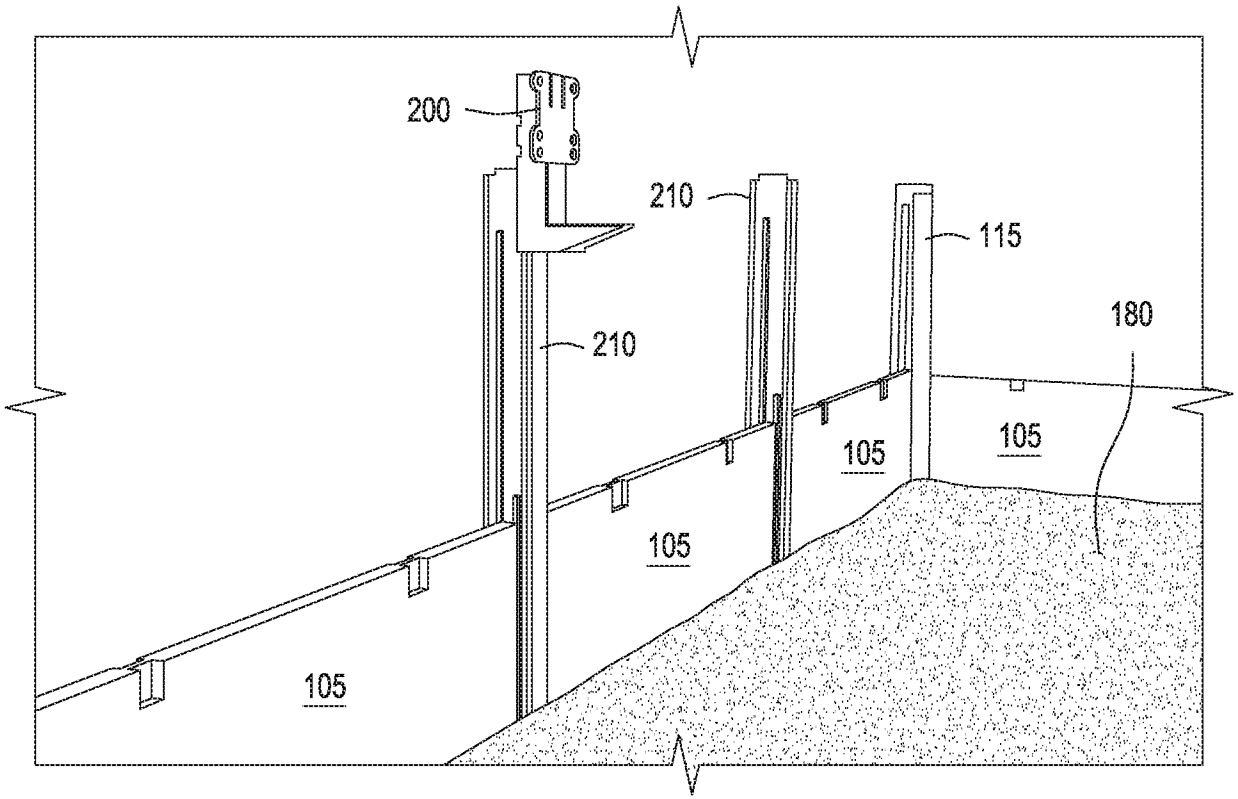
FIG. 8 depicts a front elevation view of the installation of a roller cart for the illustrative excavation support system, according to one or more embodiments provided herein.

FIG. 8 depicts a front elevation view of the installation of a roller cart for an illustrative excavation support system, according to one or more embodiments. For example, in some embodiments at least one roller cart 200 can be disposed onto each of a plurality of linear slide-rail posts 210. In other embodiments of the excavation support system 100, a roller cart 200 may be displaced only on particular rails, where other rails may not include a roller cart 200. Each roller cart 200 can be moveable in an upward and downward direction relative to the vertical axis of the linear slide-rail post 210 without interference from the elongated panel 105, 106.

Figure 9:
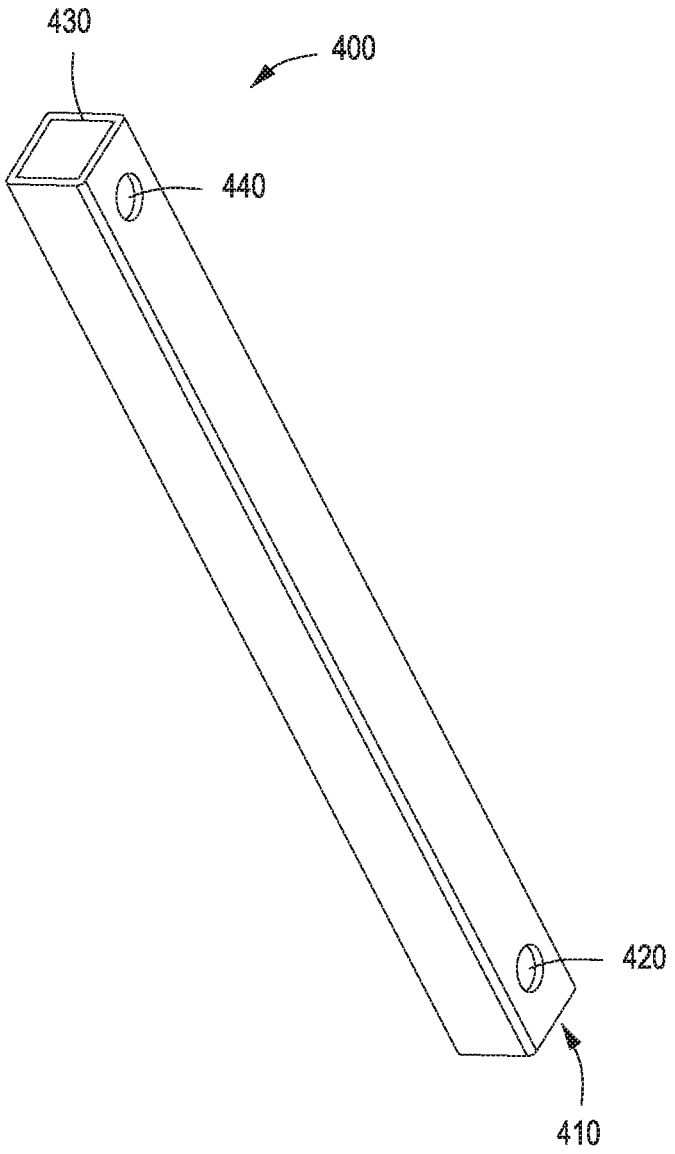
FIG. 9 depicts a side elevation view of a linking beam for the illustrative roller cart of FIG. 1, according to one or more embodiments described herein.

FIG. 9 depicts a side elevation view of a linking beam for the illustrative roller cart of FIG. 1 according to one or more embodiments. For example, the linking beam 400 can be connected to a first roller cart 200 at or near the bottom end 410, and secured at the aperture 420. The linking beam 400 can also be connected to a second roller cart 200 at or near the top end 430, and secured at the aperture 440. More specifically, the linking beam 400 can be configured to connect the first roller cart 200 and the second roller cart 200 when vertically aligned. The bottom end 410 of the linking beam 400 can be positioned between the first side plate 209 and the second side plate 209 of the first roller cart 200. Whereas, the top end 430 of the linking beam 400 can be positioned between the first side plate 209 and the second side plate 209 of the second roller cart 200.

Figure 10:
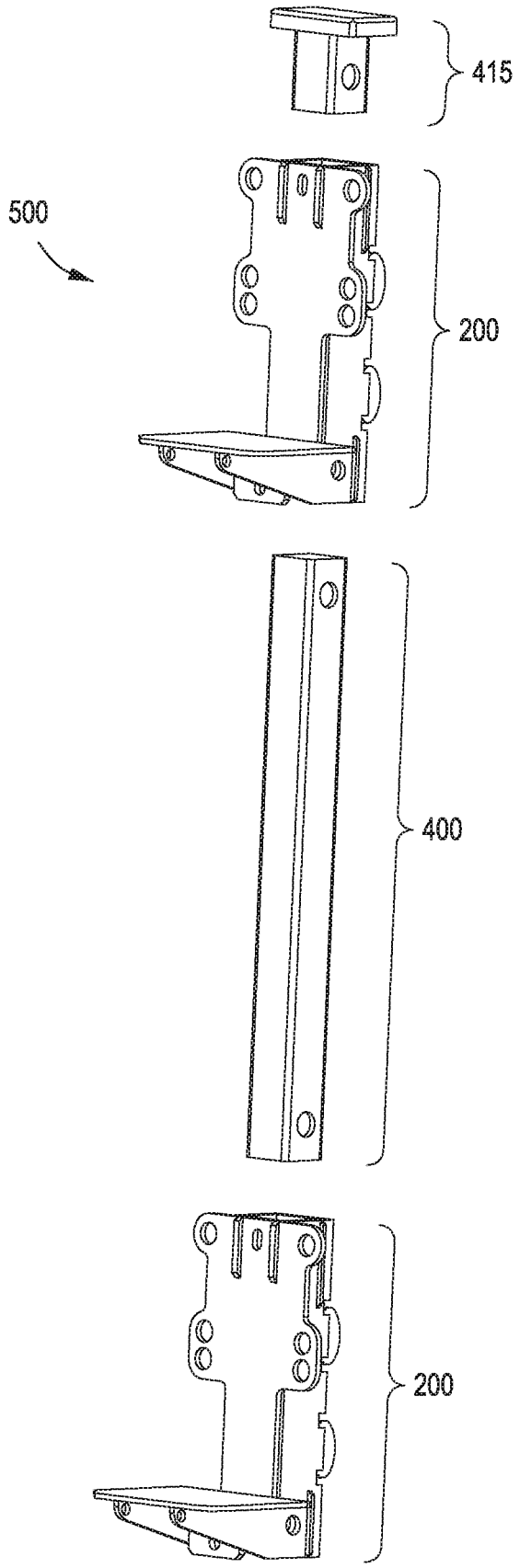
FIG. 10 is an exploded view of a roller cart system with two roller carts, a linking beam, and an optional pounding cap, according to one or more embodiments described herein.

FIG. 10 is an exploded view of a cart system 500 with two roller carts 200, according to one or more embodiments. As discussed above, the linking beam 400 can connect two roller carts 200, thereby forming a cart system 500. The boom of an excavator can be used to push the cart system 500 in the downward direction, where the point of connection between the boom and the cart system 500 can be located at the pounding cap 415. In other embodiments, the cart system 500 can include an optional lift ring (not shown), whereas the optional lift ring can be connected to the uppermost roller cart 200 in place of the cap 415. In other embodiments, the cart system 500 can operate without either the pounding cap 415 or a lift ring.

Figure 11:
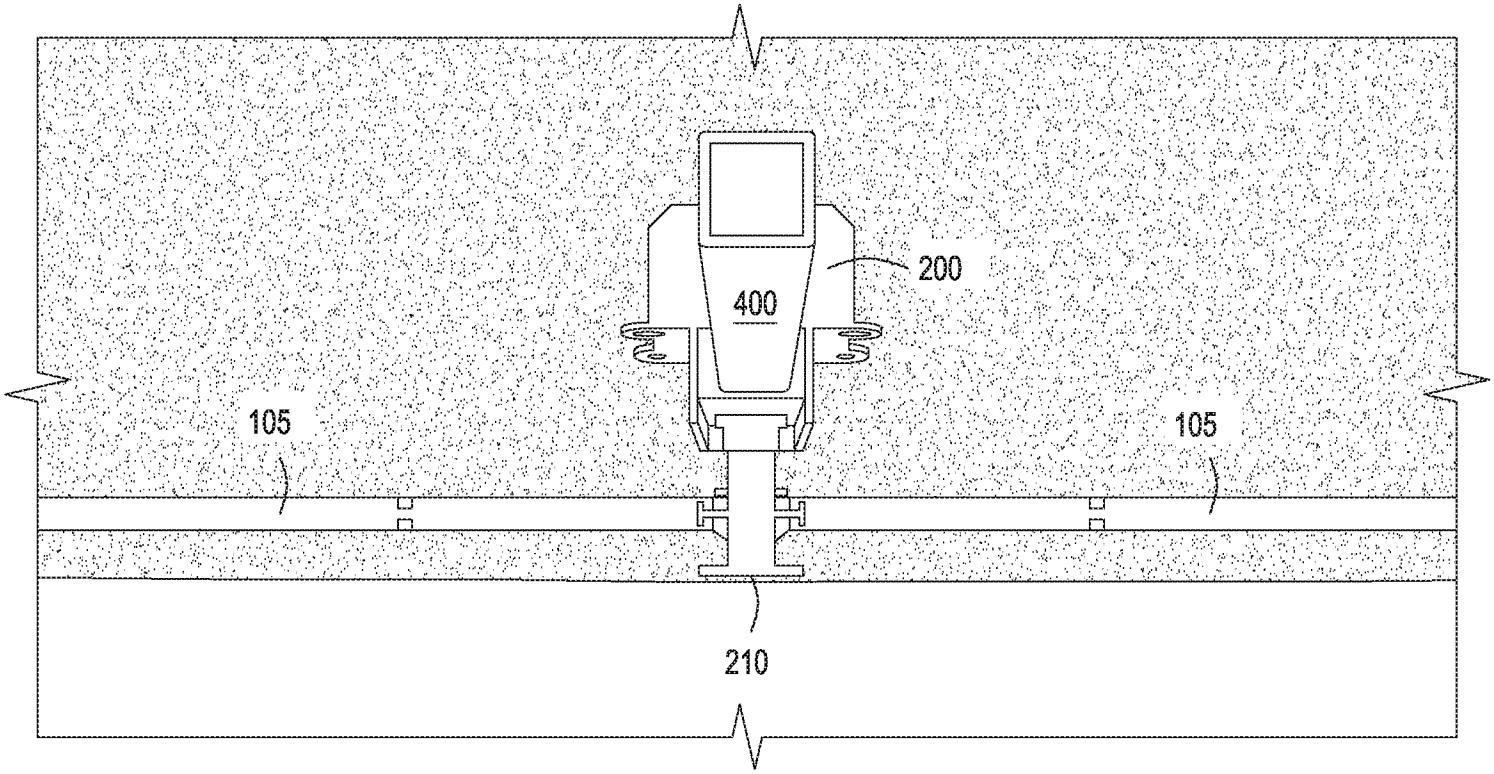
FIG. 11 a top elevation view of the installation of the roller cart of FIG. 1 with the illustrative linking beam of FIG. 8 for an illustrative excavation support system, according to one or more embodiments provided herein.

FIG. 11 depicts a top elevation view of the installation of the roller cart of FIG. 1 for use in an excavation support system, according to one or more embodiments. As discussed above, in some embodiments, a second roller cart 200 can be connected to the linking beam 400 at or near the top end 430 after installation of the first roller cart 200 and the linking beam 400 onto the linear slide-rail post 210. In other embodiments, the second roller cart 200 can be connected to the linking beam 400 and the first roller cart 200 before the installation of the cart system 500 onto the linear slide-rail post 210.

Figure 12:
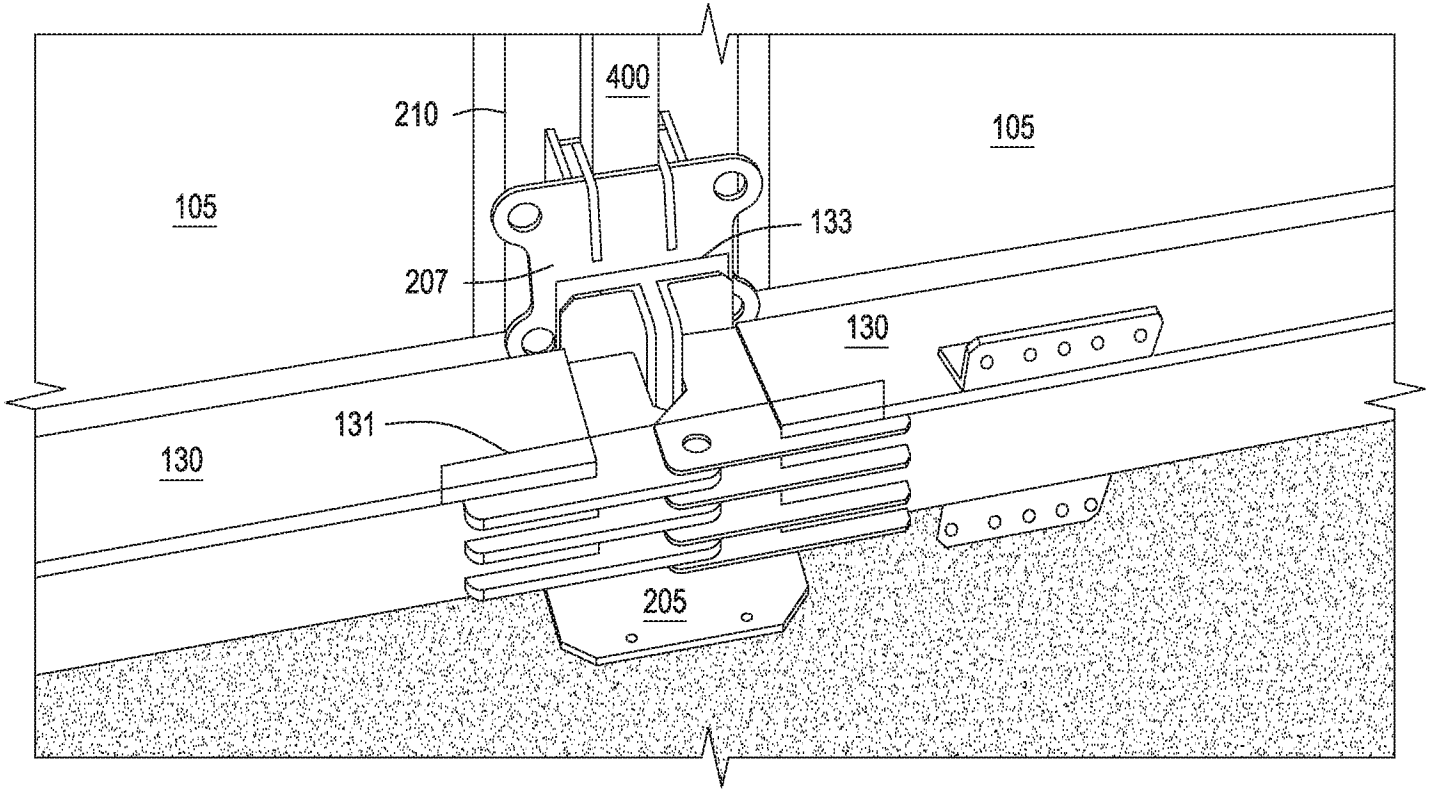
FIG. 12 is a front elevation view of a roller cart with two wale beams connected and disposed on the base plate thereof, according to one or more embodiments provided herein.

FIG. 12 is a front elevation view of a roller cart with a wale beam disposed on the base plate thereof, according to one or more embodiments. The wale beams 130 can be hydraulic wale beams 130, whereby hydraulic pressure can be applied thereto, allowing the wale beams 130 to provide structural support for the linear slide-rails 210, preventing soil from pushing the linear slide-rail 210 forward or inward. The wale beams 130 can have a variety of connecting end pieces 131. In some embodiments, the end pieces 131 can be fixedly attached or welded to the wale beams 130. In other embodiments, the end pieces 131 can be fixedly attached to the roller cart 200. In some embodiments, the wale beams 130 can also include an additional connector plate 133 that can facilitate a connection to the back plate 207 of the roller cart 200. In some embodiments, the wale beams 130 may not be fixedly connected to the roller cart 200.

In some embodiments, the aperture 255 (see FIG. 3) can be configured for connecting or securing devices that can facilitate the adjoining of two wale beams 130. For example, a first wale beam 130 can be connected to a second wale beam 130, where both the first and the second wale beams 130 can have apertures formed therethrough, configured to overlap and align with one another, that can be positioned adjacent to the aperture 255 in the base plate 205. Connectors can be inserted through the base plate aperture 255 and adjacent wale beam 130 aperture to ensure a secure connection therebetween. Additionally, wale beam supports 135 can be connected to two wale beams 130 that are perpendicular to each other to provide additional support to the wale beams 130.

The slide carts 200, the linear slide-rail posts 210, and the linking beams 200 can be fabricated from one or more metallic materials. Suitable metallic materials, for example, can include steel, stainless steel, aluminum, copper, nickel, cast iron, galvanized or non-galvanized metals, or any alloys or mixtures thereof.

Figure 13:
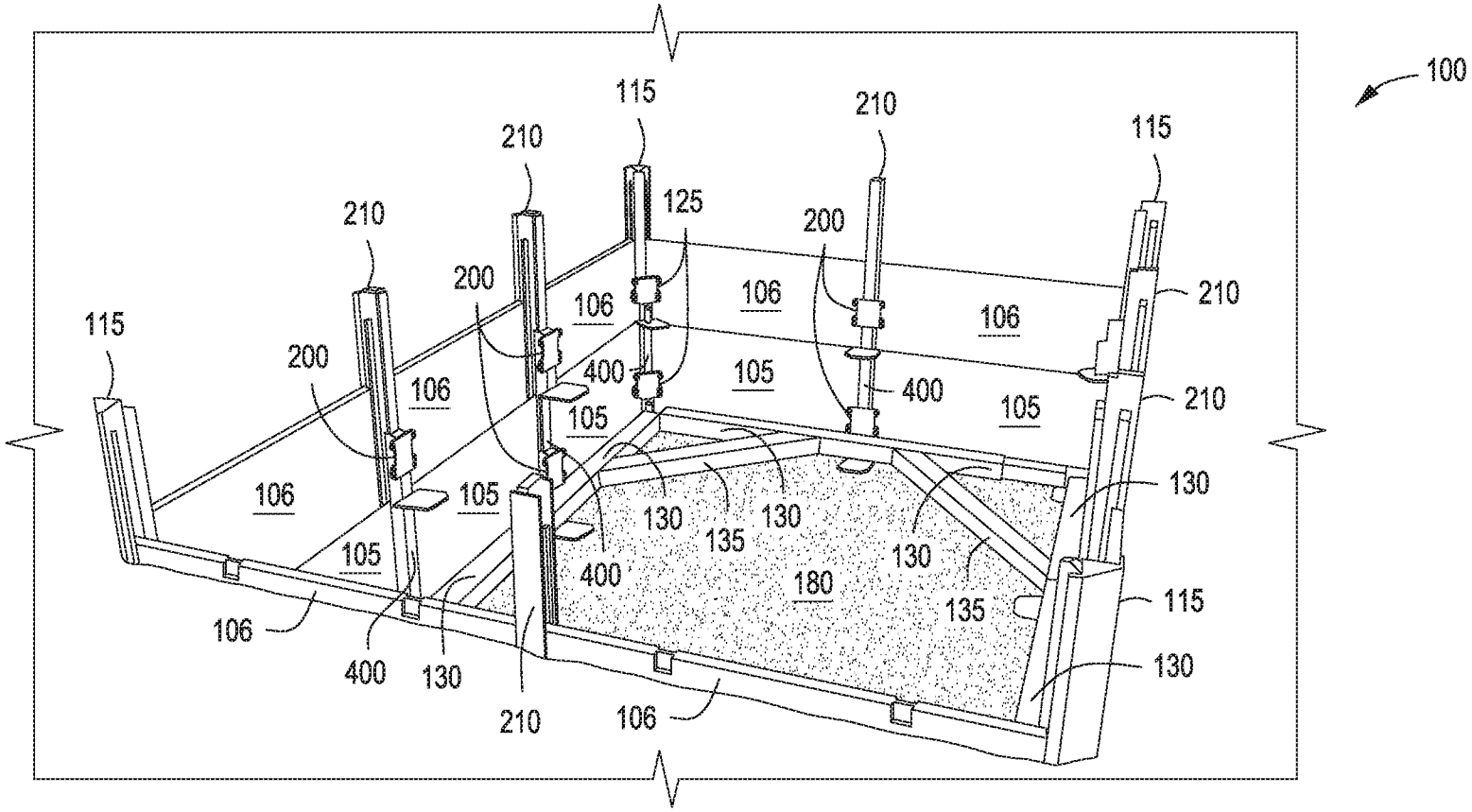
FIG. 13 depicts a top elevation view of an illustrative excavation support system, according to one or more embodiments provided herein.

FIG. 13 depicts a top elevation view of an illustrative excavation support system, according to one or more embodiments. The excavation support system 100 can include a plurality of linear slide rail posts 210, a plurality of corner slide-rail posts 115, a plurality of elongated panels 105, 106, a plurality of roller carts 200, and a plurality of corner roller carts 125. The shape of the excavation support system 100 can vary. For example, it can be square, rectangular, hexagonal, or any other shape or geometric pattern. In some embodiments, excavation support system 100 can include two levels of elongated panels (lower elongated panel 105 and upper elongated panel 106) layered one on top of the other. The number of levels will depend on the depth of the excavation.

The excavation support system 100 can be used for trench depths ranging from 10 feet to 35 feet, from 15 feet to 30 feet, or from 20 feet to 25 feet. For example, the excavation system 100 can be used for trench depths up to 35 feet, up to 25 feet, up to 20 feet, or up to 15 feet. The height of the individual elongated panels 105, 106 can range from 5 feet to 10 feet, from 6 feet to 9 feet, from 7 feet to 8 feet. For example, the height of the elongated panels 105, 106 can be up to 10 feet, up to 9 feet, up to 8 feet, up to 7 feet, or up to 6 feet. Whereas, the length of the individual elongated panels 105, 106 can range from 10 feet to 20 feet, from 12 feet to 18 feet, or from 14 feet to 16 feet in length. For example, the length of the elongated panels 105, 106 can be up to 20 feet, up to 18 feet, up to 16 feet, up to 14 feet, or up to 12 feet in length. The working width inside of the excavation support system 100 can range from 12 feet to 25 feet, from 14 feet to 23 feet, from 16 feet to 20 feet, or from 17 feet to 18 feet. For example, the working width of the excavation support system 100 can be up to 25 feet, up to 23 feet, up to 20 feet, up to 18 feet, up to 17 feet, up to 16 feet, or up to 14 feet in width.

A method of installing the roller cart 200 in the excavation support system 100 can include disposing at least one roller cart 200 onto each of the plurality of linear slide-rail posts 210 by slideably connecting the roller cart 200 to the linear slide-rail post 210. The at least one roller cart 200 can be adapted to slide onto each of the plurality of linear slide-rail posts 210 and secure thereto, where the at least one roller 212 can contact the linear slide-rail post 210 at or near the extended faceplates 294 thereof. The at least one roller cart 200 can be moved in a downward direction to the desired stopping position on the post 210. One such stopping position can be, for example, at the base of a trench 180 or any other point along the way.

In some embodiments, a first roller cart 200 can be disposed on each of the plurality of linear slide-rail posts 210, connecting to the bottom end 410 of a linking beam 400, where the linking beam 400 can be positioned between the parallel side plates 209 of the first roller cart 200. A second roller cart 200 can be disposed on each of the plurality of linear slide-rail posts 210, connecting to the top end 430 of the linking beam 400, where the linking beam 400 can be positioned between the parallel side plates 209 of the second roller cart 200, and where the second roller cart 200 can be in vertical alignment with the first roller cart 200, thereby forming a cart system 500 between the vertically aligned roller carts 200 and the linking beam 400.

In some embodiments, after the installation of the at least one roller cart 200, at least one wale beam 130 can be disposed onto the base plate 205 of the roller cart 200. In some embodiments, the wale beam 130 can be placed atop the base plate 205 without any connectors, being held in the desired position by hydraulic pressure applied thereon. Moreover, for example, in other embodiments, the wale beam 130 can be connected to the base plate 205 with connectors, such as a pin, bolt, screw, dowel, or any other appropriate connector. In other embodiments, two wale beams 130 can be connected to one another and disposed on the base plate 205. More specifically, in some embodiments, the wale beam 130 can be positioned between a corner slide-rail post 115 and a linear slide-rail post 210. For example, one end of the wale beam 130 can be disposed on the base plate 205 of the roller cart 200, where the roller cart 200 can be disposed on the linear slide-rail post 210, and the opposing end of the wale beam 130 can be disposed on the base plate 205 of a corner roller cart 125, where the corner roller cart 125 can be disposed on the corner slide-rail post 115.

The load capacity of the roller cart 200 can range from about 2,000 pounds to about 10,000 pounds, from about 3,000 pounds to about 9,000 pounds, from about 4,000 pounds to about 8,000 pounds or from about 5,000 pounds to about 7,000 pounds. For example, the load capacity of the roller cart 200 can be up about 10,000 pounds, up to about 9,000 pounds, up to about 8,000 pounds, or up to about 7,000 pounds. The total length of the roller cart 200, as measured from the top end 225 of the back plate 207 to the bottom portion 307 of the side plates 209, can range from about 20 inches to about 40 inches, from about 22 inches to about 38 inches, from about 24 inches to about 36 inches, from about 26 inches to about 34 inches, or from about 28 inches to about 32 inches. For example, the total length of the roller cart 200 can be up to about 40 inches, up to about 38 inches, up to about 36 inches, up to about 34 inches, or up to about 32 inches. The roller cart 200 can have a width ranging from about 15 inches to about 35 inches, from about 18 inches to about 32 inches, from about 21 inches to about 29 inches, or from about 24 inches to about 26 inches. For example, the roller cart 200 can have a width of up to about 35 inches, up to about 32 inches, up to about 29 inches, or up to about 26 inches.

A method of excavating an area can include the following steps. A trench having an inward facing side and an outer facing side can be dug using standard excavating equipment such as a backhoe or excavator. The trench can outline a square, rectangular, hexagonal, or any other shape or geometric pattern any geometric shape. A first elongated panel 105 can be inserted along the outer facing side of the trench. A linear slide rail post 210 can then be inserted where the front recessed groove or track 291 can function as an outer track 291, wherein the first lower elongated panel 105 can be slideably positioned therein on both sides of the linear slide rail post. Corner slide-rail posts 115 can be used to connect the lower elongated panels 105 where the trench forms corners also using the front groove 291. These corners can be approximately 90° such that the angle formed between two corner lower elongated panels 105 is also approximately 90°. Once the lower elongated panels 105 and slide rail posts 210 and 115 are inserted along the entire outer facing side of the trench, the area outlined by the trench can be excavated. After the area is excavated, first roller carts 200 can be slideably inserted on slide rail post 210 and first roller carts 125 can be slideably inserted on corner slide rail posts 115. Wale beams 130 can then be connected to first roller carts 200 and first corner rail carts 125. Additional support wale beams 135 can also be connected to wale beams 130. Linking beams 400 can be connected to the first roller cart 200 or first corner roller cart at or near the bottom end 410, and secured at the aperture 420. The linking beam 400 can also be connected to a second roller cart 200 or second corner roller cart at or near the top end 430, and secured at the aperture 440. After the wale beams 130 are connected to the first roller carts 200 and first corner roller carts 125, a second set of lower elongated panels (not shown) can be slideably positioned in the additional recessed groove or track 290 that can function as an inner track 290 of the linear slide rail posts 210 and corner slide rail posts 115. Wale beams 130 can be connected to the second roller carts 200 and second corner rail carts 125. Additional support wale beams 135 can also be connected to wale beams 130. After the wale beams 130 are connected to the second roller carts 200 and second corner rail carts 125, one of the two lower elongated panels connected to the slide posts 210 and 115 can be forced further into the ground using any machinery capable of generating enough downward force such as a backhoe. After the entire perimeter of lower elongated panels is lowered, the area inside is excavated again and the system of roller carts 200, corner roller carts 125, linear slide rail posts 210, corner slide rail posts 115, wale beams 130 and support wale beams 135 is lowered to the base of the excavated area. First upper elongated panels 106 can be slideably positioned in grove 290 or 291 of the linear slide rail posts 210 and corner slide rail posts 115 such that the first upper elongated panels 106 are in the same grove 290 or 291 as the lower elongated panel that has not been forced further into the ground. After the first upper elongated panels 106 are in place, the first upper elongated panel and the lower elongated panel can be forced further into the ground until the first lower elongated panels and the second lower elongated panels are at substantially the same depth. A second upper elongated panel can be inserted in the grove 290, 291 that is not occupied by the first upper elongated panel. This process can be repeated until the depth of the excavated area is 3, 4, 5, or more panels deep.

Embodiments of the present disclosure further relate to any one or more of the following paragraphs 1 to 20:

1. A roller cart for an excavation support system, comprising: (a) a generally vertical back plate having a front surface, a back surface, a top end, and a bottom end; (b) a generally horizontal base plate having a top side and a bottom side attached to the back plate at about a 90-degree angle proximate the bottom end of the back plate; (c) a first side plate and a second side plate, wherein both side plates are generally L-shaped, having a generally vertical top portion, and a bottom portion that is generally perpendicular to the top portion, and wherein the top portion of both side plates is attached to, and generally perpendicular to, the back surface of the back plate, wherein the bottom portion of both side plates is attached to, and generally perpendicular to, the bottom side of the base plate, and wherein the first side plate and the second side plate are generally parallel to one another; (d) a first plurality of guide plates attached to, and generally perpendicular to, the generally vertical top portion of the first side plate, and a second plurality of guide plates attached to, and generally perpendicular to, the generally vertical top portion of the second side plate; and (e) at least one roller connected to the back plate and extending from the back surface thereof.

2. The roller cart according to paragraph 1, wherein the roller cart is movable in an upward and downward direction relative to the vertical axis of a linear slide-rail post, and wherein the roller cart is adapted to slide onto the linear slide-rail post and secure thereto.

3. The roller cart according to paragraph 1 or 2, wherein the linear slide-rail post further comprises an extended faceplate disposed along the longitudinal axis thereof.

4. The roller cart according to any one or more paragraphs 1 to 3, wherein the guide plates are configured to slide onto and secure to the extended faceplate of the linear slide-rail post, and wherein the guide plates are configured to facilitate slideable movement of the roller cart in an upward and downward direction relative to the vertical axis of the linear slide-rail post.

5. The roller cart according to any one or more paragraphs 1 to 4, wherein the base plate is configured to support at least one wale beam.

6. The roller cart according to any one or more paragraphs 1 to 5, wherein the back plate further comprises a first outer edge and a second outer edge, wherein the first outer edge has at least one aperture formed therethrough proximate the top end, and wherein the second outer edge of the back plate has at least one aperture formed therethrough proximate the top end.

7. The roller cart according to any one or more paragraphs 1 to 6, wherein the at least one aperture formed through the first outer edge and the at least one aperture formed through the second outer edge are configured to be engaged with a connecting device.

8. The roller cart according to any one or more paragraphs 1 to 7, wherein at least a portion of both the first outer edge proximate the top end of the back plate and the second outer edge proximate the top end of the back plate is curved, and wherein the aperture is formed through the curved portion of both the first outer edge and the second outer edge.

9. The roller cart according to any one or more paragraphs 1 to 8, wherein the first outer edge of the back plate further comprises at least one aperture formed therethrough positioned below the at least one aperture proximate the top end, and wherein the second outer edge of the back plate further comprises at least one aperture formed therethrough positioned below the at least one aperture proximate the top end.

10. The roller cart according to any one or more paragraphs 1 to 9, wherein the at least one aperture formed therethrough positioned below the at least one aperture proximate the top end of the first outer edge of the back plate is configured to be engaged with a connecting device, and wherein the at least one aperture formed therethrough positioned below the at least one aperture proximate the top end of the second outer edge of the back plate is configured to be engaged with a connecting device.

11. A roller cart system for an excavation support system, comprising: (a) a first roller cart and a second roller cart, each of the roller carts comprising: a generally vertical back plate having a front surface, a back surface, a top end, and a bottom end; a generally horizontal base plate, having a top side and a bottom side, attached to the back plate at about a 90-degree angle, proximate the bottom end of the back plate; a first side plate and a second side plate, wherein both side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another; a first plurality of guide plates attached to, and generally perpendicular to the generally vertical top portion of the first side plate, and a second plurality of guide plates attached to, and generally perpendicular to the generally vertical top portion of the second side plate; at least one roller, connected to the back plate, extending from the back surface thereof; and (b) a linking beam configured to connect the first roller cart and the second roller cart when vertically aligned, wherein the linking beam has a top end and a bottom end, wherein the bottom end is positioned between the first side plate and the second side plate of the first roller cart, and wherein the top end is positioned between the first side plate and the second side plate of the second roller cart; the roller cart system being moveable in an upward and a downward direction relative to a vertical axis.

12. The roller cart system according to paragraph 11, wherein the roller cart system is movable in an upward and a downward direction relative to the vertical axis of a linear slide-rail post, and wherein the roller cart system is adapted to slide onto the linear slide-rail post and secure thereto.

13. The roller cart system according to paragraphs 11 or 12, wherein the linear slide-rail post further comprises an extended faceplate disposed along the longitudinal axis thereof.

14. The roller cart system according to any one or more paragraphs 11 to 13, wherein the plurality of guide plates of both roller carts are configured to slide onto and secure to the extended faceplate of the linear slide-rail post, and wherein the plurality of guide plates are configured to facilitate slideable movement of the roller cart system in an upward and a downward direction relative to the vertical axis of the linear slide-rail post.

15. The roller cart system according to any one or more paragraphs 11 to 14, wherein the base plates of both roller carts are configured to support at least one wale beam.

16. The roller cart system according to any one or more paragraphs 11 to 15, wherein the linking beam is at least twice the length of the back plates of both roller carts.

17. A method of installing a roller cart in an excavation support system, comprising: disposing at least a first roller cart on a linear slide-rail post, wherein the roller cart comprises: (i) a generally vertical back plate having a front surface, a back surface, a top end, and a bottom end; (ii) a generally horizontal base plate having a top side and a bottom side attached to the back plate at about a 90-degree angle proximate the bottom end of the back plate; (iii) a first side plate and a second side plate wherein both side plates are generally L-shaped having a generally vertical top portion and a bottom portion that is generally perpendicular to the top portion, wherein the top portion of both side plates is attached to and generally perpendicular to the back surface of the back plate, and wherein the bottom portion of both side plates is attached to and generally perpendicular to the bottom side of the base plate, and wherein the first side plate and the second side plate are generally parallel to one another; (iv) a first plurality of guide plates attached to, and generally perpendicular to, the generally vertical top portion of the first side plate and a second plurality of guide plates attached to, and generally perpendicular to, the generally vertical top portion of the second side plate; at least one roller connected to the back plate, extending from the back surface thereof, wherein the roller cart is movable in an upward and downward direction relative to a vertical axis.

18. The method according to paragraph 17, further comprising moving the roller cart in the downward direction relative to the vertical axis of the linear slide-rail post to a desired stopping position.

19. The method according to paragraph 17 or 18, further comprising connecting a linking beam to the first roller cart in vertical alignment therewith, the linking beam having a top end and a bottom end, wherein the bottom end is positioned between the first side plate and the second side plate of the first roller cart.

20. The method according to any one or more paragraphs 17 to 19, further comprising: moving the first roller cart and the linking beam in the downward direction relative to the vertical axis of the linear slide-rail post to a first stopping position; disposing a second roller cart onto the linear slide-rail post; moving the second roller cart in the downward direction relative to the vertical axis of the linear slide-rail post to a second stopping position, wherein the second stopping position is the top end of the linking beam; and positioning the top end of the linking beam between the first side plate and the second side plate of the second roller cart and connecting thereto.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, patent application publications, test procedures, and other documents cited in this application are fully incorporated by reference herein to the extent such disclosure is not inconsistent with this application and for all jurisdictions in which such incorporation is permitted.

While the foregoing has been disclosed and described in preferred forms with a certain degree of particularity, it is understood that the present disclosure of the preferred forms is only by way of example and that numerous changes in the details of operation and in the combination and arrangement of parts may be resorted to without departing from the spirit and scope of the invention, which is defined by the claims that follow.

What is claimed is:

1. A roller cart for an excavation support system, comprising:

a generally vertical back plate;

a generally horizontal base attached to and extending away from a lower portion of the back plate;

a first side plate and a second side plate wherein both side plates are generally L-shaped, wherein a generally vertical portion of each side plate is attached to a back surface of the back plate, and a generally horizontal portion of each side plate is attached to and disposed beneath a bottom side of the base plate, and wherein the first side plate and the second side plate are generally parallel to one another;

a first plurality of guide plates disposed on the generally vertical portion of the first side plate, and extending generally perpendicular from the first side plate;

a second plurality of guide plates disposed on the generally vertical portion of the second side plate and extending generally perpendicular from the second side plate; and at least one roller secured between the generally vertical portions of the first and second side plates and beneath the first and second plurality of guide plates.

2. The roller cart of claim 1, wherein the roller cart is movable relative to the vertical axis of a linear slide-rail post, and wherein the roller cart is adapted to slide onto the linear slide-rail post and secure thereto.

3. The roller cart of claim 2, wherein the linear slide-rail post further comprises an extended faceplate disposed along the longitudinal axis thereof.

4. The roller cart of claim 3, wherein the guide plates are configured to slide onto and secure to the extended faceplate of the linear slide-rail post, and wherein the guide plates are configured to facilitate movement of the roller cart relative to the vertical axis of the linear slide-rail post.

5. The roller cart of claim 4, wherein the base plate is configured to support at least one hydraulic wale beam.

6. The roller cart of claim 1, wherein the back plate further comprises at least two apertures formed through the top end thereof for engaging with a connection device.

7. The roller cart of claim 6, wherein the apertures are configured to provide lift points for moving the roller cart, or connection points for connecting the roller cart to the linear slide-rail post or connecting one or more wale beams to the roller cart.

8. The roller cart of claim 6, wherein the back plate further comprises at least two apertures formed below the two apertures formed through the upper end for engaging with a connection device.

9. The roller cart of claim 8, wherein the apertures formed below the apertures formed through the upper end are configured to provide additional lift points for moving the roller cart, or connection points for connecting the roller cart to the linear slide-rail post or connecting one or more wale beams to the roller cart.

10. A roller cart system for an excavation support system, comprising:

a first roller cart and a second roller cart, each of the roller carts comprising: a generally vertical back plate; a generally horizontal base plate attached to and extending away from a lower portion of the back plate; a first side plate and a second side plate wherein both side plates are generally L-shaped, wherein a generally vertical portion of each side plate is attached to a back surface of the back plate, and a generally horizontal portion of each side plate is attached to and disposed beneath a bottom side of the base plate, and wherein the first side plate and the second side plate are generally parallel to one another; a first plurality of guide plates disposed on the generally vertical portion of the first side plate, and extending generally perpendicular from the first side plate; a second plurality of guide plates disposed on the generally vertical portion of the second side plate and extending generally perpendicular from the second side plate; at least one roller secured between the generally vertical portions of the first and second side plates and beneath the first and second plurality of guide plates; and a linking beam configured to connect the first roller cart and the second roller cart when vertically aligned, wherein the linking beam has a upper end and a lower end, wherein the lower end is positioned between the first side plate and the second side plate of the first roller cart, and wherein the upper end is positioned between the first side plate and the second side plate of the second roller cart, the roller cart system being moveable in an upward and a downward direction relative to a vertical axis.

11. The roller cart system of claim 10, wherein the roller cart system is movable relative to the vertical axis of a linear slide-rail post, and wherein the roller cart system is adapted to slide onto the linear slide-rail post and secure thereto.

12. The roller cart system of claim 11, wherein the linear slide-rail post further comprises an extended faceplate disposed along the longitudinal axis thereof.

13. The roller cart system of claim 12, wherein the plurality of guide plates of both roller carts are configured to slide onto and secure to the extended faceplate of the linear slide-rail post, and wherein the plurality of guide plates are configured to facilitate movement of the roller cart system relative to the vertical axis of the linear slide-rail post.

14. The roller cart system of claim 13, wherein the base plates of both roller carts are configured to support at least one hydraulic wale beam.

15. The roller cart system of claim 10, wherein the linking beam is at least twice the length of the back plates of both roller carts.

16. A method of installing a roller cart in an excavation support system, comprising:

disposing at least a first roller cart on a linear slide-rail post wherein the roller cart comprises: a generally vertical back plate; a generally horizontal base plate attached to and extending away from a lower portion of the back plate; a first side plate and a second side plate wherein both side plates are generally L-shaped, wherein a generally vertical portion of each side plate is attached to a back surface of the back plate, and a generally horizontal portion of each side plate is attached to and disposed beneath a bottom side of the base plate, and wherein the first side plate and the second side plate are generally parallel to one another; a first plurality of guide plates disposed on the generally vertical portion of the first side plate, and extending generally perpendicular from the first side plate; a second plurality of guide plates disposed on the generally vertical portion of the second side plate and extending generally perpendicular from the second side plate; at least one roller secured between the generally vertical portions of the first and second side plates and beneath the first and second plurality of guide plates; and the roller cart is moveable relative to a vertical axis.

17. The method of claim 16, further comprising moving the roller cart relative to the vertical axis of the linear slide-rail post to a desired stopping position.

18. The method of claim 16, further comprising connecting a linking beam to the first roller cart in vertical alignment therewith, the linking beam having an upper end and lower end, wherein the bottom end is positioned between the first side plate and the second side plate of the first roller cart.

19. The method of claim 18, further comprising:

moving the first roller cart and the linking beam relative to the vertical axis of the linear slide-rail post to a first stopping position;

disposing a second roller cart onto the linear slide-rail post;

moving the second roller cart relative to the vertical axis of the linear slide-rail post to a second stopping position, wherein the second stopping position is the upper end of the linking beam; and positioning the upper end of the linking beam between the first side plate and the second side plate of the second roller cart and connecting thereto.

* * * * *